US008165712B2

(12) United States Patent
Speich

(10) Patent No.: US 8,165,712 B2
(45) Date of Patent: Apr. 24, 2012

(54) LOOM, IN PARTICULAR A RIBBON LOOM

(75) Inventor: Francisco Speich, Gipf-Oberfrick (CH)

(73) Assignee: Textilma AG (CH)

( * ) Notice: Subject to any disclaimer, the term of this patent is extended or adjusted under 35 U.S.C. 154(b) by 781 days.

(21) Appl. No.: 12/226,288

(22) PCT Filed: Apr. 20, 2007

(86) PCT No.: PCT/CH2007/000192

§ 371 (c)(1),
(2), (4) Date: Oct. 14, 2008

(87) PCT Pub. No.: WO2007/128143

PCT Pub. Date: Nov. 15, 2007

(65) Prior Publication Data

US 2009/0288730 A1 Nov. 26, 2009

(30) Foreign Application Priority Data

May 4, 2006 (CH) ..... 720/06

(51) Int. Cl.
*G06F 19/00* (2006.01)

(52) U.S. Cl. ..... 700/140; 139/116.1

(58) Field of Classification Search ..... 700/130, 700/140, 141; 139/116.1, 135.2, 452
See application file for complete search history.

(56) References Cited

U.S. PATENT DOCUMENTS 4,577,665 A * 3/1986 Diesner ..... 139/431
4,646,792 A * 3/1987 Villa et al. ..... 139/452
4,702,285 A * 10/1987 Sugita ..... 139/452
5,002,095 A 3/1991 Herrin et al.
5,069,257 A 12/1991 Borisch
5,295,516 A * 3/1994 Tanaka et al. ..... 139/452
5,320,142 A * 6/1994 Sainen ..... 139/435.2
5,623,973 A * 4/1997 Josefsson ..... 139/452
5,878,787 A * 3/1999 Speich ..... 139/22
6,010,052 A * 1/2000 Leins et al. ..... 226/44
7,110,847 B2 * 9/2006 Ostyn ..... 700/140
7,465,695 B2 * 12/2008 Tischer et al. ..... 503/227
7,484,667 B2 * 2/2009 Speich ..... 235/494
7,533,545 B2 * 5/2009 Mele et al. ..... 66/84 A
7,726,351 B2 * 6/2010 Puissant et al. ..... 139/435.1
7,762,288 B2 * 7/2010 Puissant ..... 139/435.2
2005/0086978 A1 * 4/2005 Zorini et al. ..... 66/203
(Continued)

FOREIGN PATENT DOCUMENTS

DE 42 22 454 A1 1/1993
(Continued)

*Primary Examiner* — Danny Worrell
(74) *Attorney, Agent, or Firm* — George Pappas

(57) ABSTRACT

The loom, in particular a ribbon loom, has at least one electrically-driven thread transport device for the weft threads for processing at least one thread or a group of threads over at least the distance between two lengths of weft. It also contains a fabric outlet for the woven fabrics and an electronic control device for controlling the loom based on a pattern program for the woven fabrics to be produced. The loom can be better adjusted to the woven fabrics to be produced, in other words to the pattern and the thread material used, if the control device has control means for adjusting automatically at the thread transport device the feed length of the thread to be delivered according to the data predefined in the pattern program, the fabric outlet, and the width of the woven fabrics to be produced.

20 Claims, 2 Drawing Sheets

U.S. PATENT DOCUMENTS

| | | | | |
|---|---|---|---|---|
| 2007/0033969 | A1 * | 2/2007 | Mele et al. ..... | 66/84 A |

FOREIGN PATENT DOCUMENTS

| | | | |
|---|---|---|---|
| DE | 42 40 709 | A1 | 6/1994 |
| DE | 101 03 342 | A1 | 8/2002 |
| EP | 1 526 199 | A1 | 4/2005 |
| GB | 2 115 022 | A | 9/1983 |
| WO | WO 85/01754 | A | 4/1985 |
| WO | WO 88/05089 | | 7/1988 |
| WO | WO 91/05895 | | 5/1991 |
| WO | WO 99/57351 | | 11/1999 |
| WO | WO 2004/111322 | A1 | 12/2004 |

* cited by examiner

LOOM, IN PARTICULAR A RIBBON LOOM

This application claims priority of PCT application PCT/CH2007/000192 having a priority date of May 4, 2006, the disclosure of which is incorporated herein by reference.

TECHNICAL FIELD

The invention relates to a loom, in particular a ribbon loom.

BACKGROUND OF THE INVENTION

Looms, in particular ribbon looms of the type initially mentioned, are commonly known. Usually, the thread quantity to be transported for warp threads and/or weft threads in looms is supplied to the processing station either under negative control, to be precise tension control, or positively with a fixed mechanical setting. The disadvantage of a negative thread control is that the threads are subjected to load, particularly when threads of different quality and properties are used. In the case of rubber threads or other threads with elasticity, the negative control has to be adapted in each case, since the threads would otherwise be loaded by harmful stresses. By contrast, in the case of a positive mechanical control with a fixed setting, there is a disadvantage that the thread feeders can operate only with an adjustable constant pull which can be set only in terms of the weakest thread, with the result that the quality of the woven cloth is impaired.

EP 1 526 199 A discloses a loom with individually drivable thread transport devices which can be activated individually according to the pattern program, but control takes place as a function of tension, and individual overriding adaptation is not provided.

WO 2004/111322 discloses, for knitting machines, a mechanism with an electronic control device for controlling the weft thread introduction, which, on the basis of a pattern program regulates an individual thread transport for the knitted cloth to be produced. The knitting machine contains, furthermore, a correcting apparatus, by means of which an adjustable correcting factor can be superposed on the pattern-compatible functioning of components of the knitting machine.

WO-A-88/05089 discloses a method for regulating the warp thread tension in looms by regulating the drive speed of the warp beam and/or of the cloth beam by means of program-controlled stepping motors. However, a regulation of the weft thread tension or quantity is not disclosed, provided or suggested there. A similar method and a corresponding device for releasing and regulating the warp thread quantity is known from WO-A-91/05895, said warp thread quantity being calculated by means of a control arrangement, for example with a keyboard. However, here, too, a regulation of the weft thread tension or quantity is not disclosed, provided or suggested.

SUMMARY OF THE INVENTION

The purpose of the invention is to improve further a loom of the type initially mentioned.

Since in a loom, in particular in a ribbon loom, with at least one electrically driven thread transport device for at least one weft thread, with a cloth take-up for the woven cloth and with an electronic control device for controlling the loom on the basis of a pattern program for the woven cloth to be produced, there is provision for the control device to have control means in order automatically to set, at the at least one thread transport device, the delivery length of the weft thread to be supplied, this ensures, in the first place, that the exact thread length required is always available for each weft thread insertion and each pattern. There is no longer any need for taking up the weft thread, for example from a cone, by means of a weft insertion device. As a result, the woven cloth, in general, and pattern formation, in particular, are improved substantially. During the weaving operation, faults, such as thread breaks and defects, are largely prevented. Since the delivery length can be calculated not only using data from the pattern program and from the cloth take-up, but, in particular, also from data relating to the width, varying greatly during the weaving operation, of the woven cloth to be produced, the result of the measures of the invention is, moreover, that such changes can be reacted to during the weaving operation.

It is advantageous in this case if the loom has an electrically driven further thread transport device for the warp threads. The control device in this case also has control means in order automatically to set at the thread transport device the delivery length of the warp threads to be supplied, according to the data predetermined in the pattern program. The delivery length of the further thread transport device for the warp threads can likewise be calculated, using data from the pattern program, the cloth take-up and the width of the woven cloth to be produced.

A particularly advantageous development is that by means of the correcting factor $K_S$ which additionally varies the pattern-compatible functioning data at least of the weft thread supply, further individual adaptation, for example, to different thread qualities and/or pattern properties of the woven cloth to be produced can be achieved. Such a correcting factor $K_K$ or $K_W$ is preferably also provided for the cloth take-up and/or the warp thread supply.

A particularly advantageous correcting apparatus has a display screen, preferably a touch screen, and also an editing element for the manual selection of various indicator and control planes, in particular that for handling the correcting factor or correcting factors.

A version of the loom is advantageous when the control of the thread transport device is designed as an integrated constituent of the machine control.

For a loom with weft threads of various types, in particular for weft threads of different color, it is advantageous if at least two electrically driven thread transport devices for weft threads are provided and the control means are designed correspondingly. In this case, it is advantageous if correcting factors different for the weft threads are provided for the thread transport devices, particularly when the weft threads of different type are supplied by these thread transport devices.

BRIEF DESCRIPTION OF THE DRAWINGS

Exemplary embodiments of the invention are described in more detail below by means of the drawings in which.

DETAILED DESCRIPTION OF THE PREFERRED EMBODIMENT

Figures 1, 2:
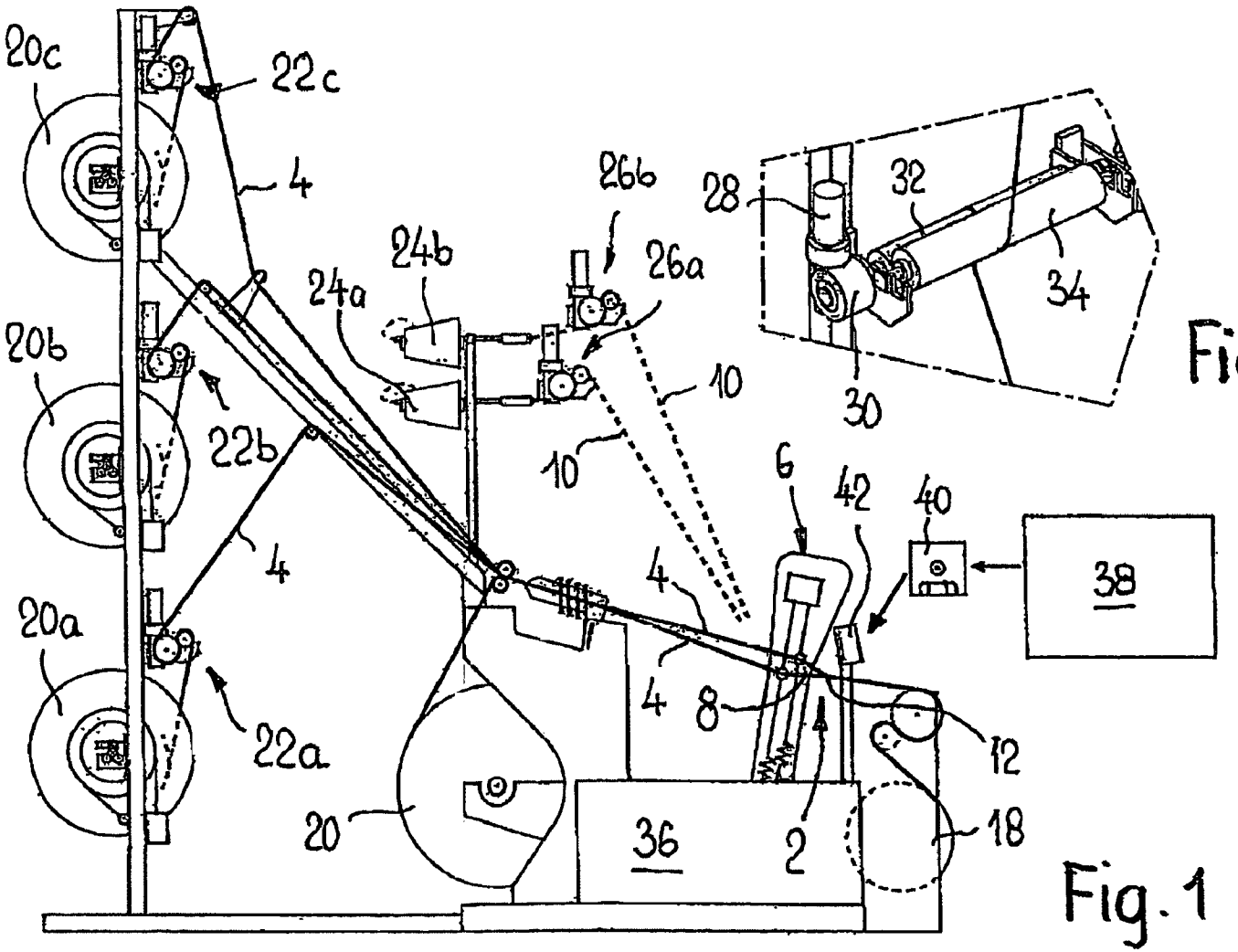
FIG. 1 shows a loom in a side view.
FIG. 2 shows a thread transport device from FIG. 1 in a diagrammatic illustration.

FIG. 1 shows a diagram of a loom, which is preferably a ribbon loom, in a side view, in which warp threads 4 are opened into a shed 8 by means of a shedding device 6 at a weaving station 2. By means of a weft device, not illustrated in any more detail, in each case a weft thread 10 is inserted into the shed 8 during each shed opening and is beaten up at the cloth edge 12 by means of a reed, likewise not illustrated in any more detail.

The woven cloth 14 produced is taken up by means of a cloth take-up 16 and rolled up into a cloth roll 18.

The warp threads are supplied to the weaving station 2 by one or more warping frames 20, 20*a*, 20*b*, 20*c*. At least a number of warping frames are assigned in each case an individually controllable thread transport device 22*a*, 22*b*, 22*c*. At the weaving station 2, further, one or more weft threads 10 can be supplied in succession, which are in each case taken up in an individually controllable way by thread bobbins 24*a*, 24*b* by means of controllable thread transport devices 26*a*, 26*b*.

FIG. 2 shows an example of such a thread transport device in a diagrammatic illustration, in which a motor 28, for example a stepping motor, drives via a gear 30 at least one of two rollers 32, 34, around which a thread 4, 10 to be transported is looped.

Figure 3:
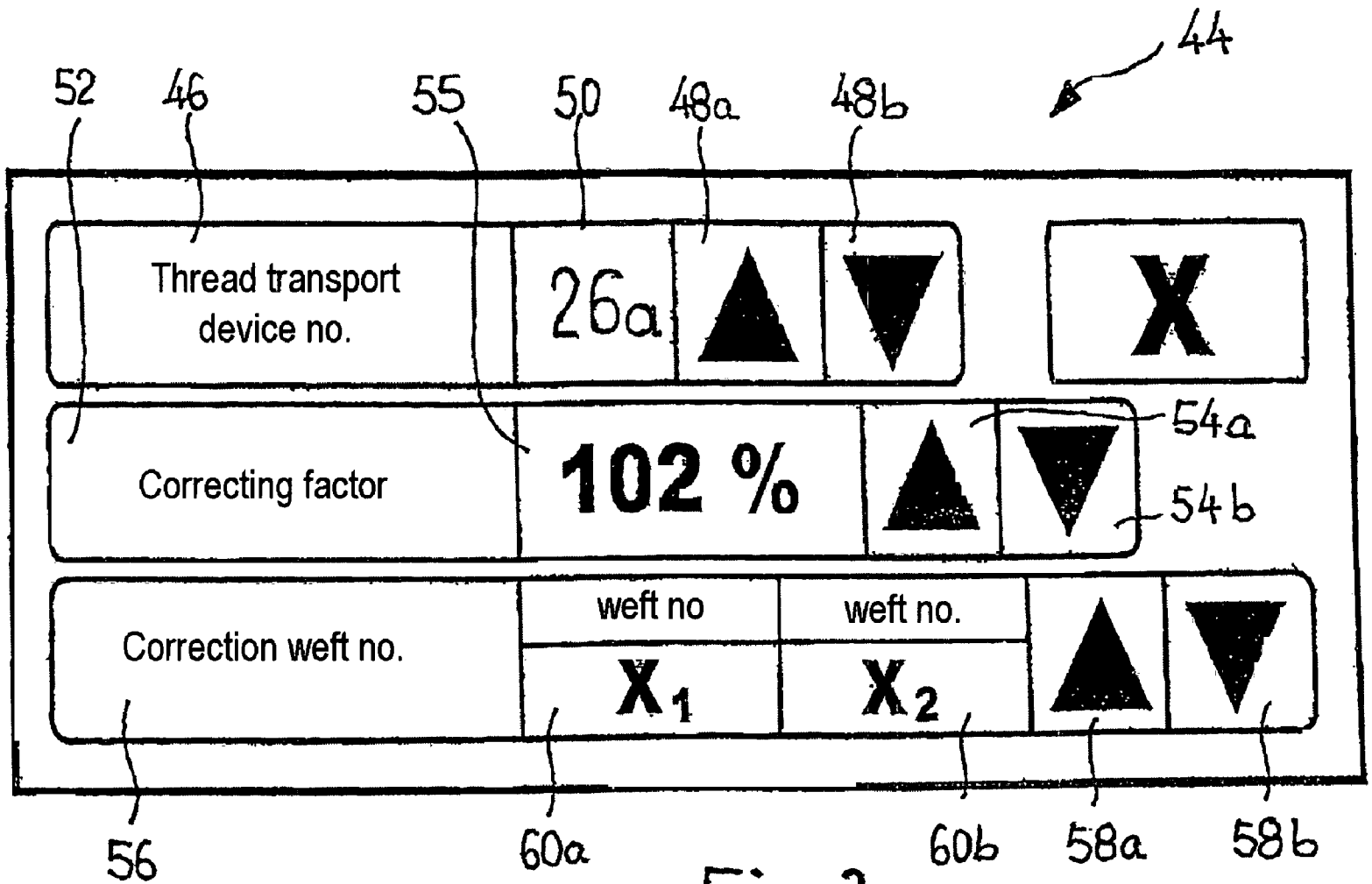
FIG. 3 shows an indicator and switching plane of a correcting apparatus for setting a correcting factor.

The loom is equipped with a control device 36 which controls the components of the loom on the basis of a pattern program. Such a pattern program may be produced either on the loom itself or on an external pattern apparatus 38, from which the pattern program is read into a reader 42 of the control device 36, for example via lines or via a floppy disk 40. The control device 36 contains control means in order to set the delivery length of the warp threads 4 to be supplied and/or of the weft threads 10 according to the cloth pattern predetermined from the pattern program. Furthermore, the control device 36 has a manual actuable correcting apparatus for individually superposing an adjustable correcting factor $K_S$ or $K_K$, which may be plus or minus, upon the delivery date of at least one weft thread 10 and of at least one warp thread 4 for at least one weft insertion. The correcting apparatus is described in more detail with reference to FIG. 3.

The correcting apparatus contains a display screen 44 which is preferably designed as a touch screen and which has a row of indicator and switching elements for manually selectable indicator and switching planes. In a first switching field 46, any desired thread transport device 22*a*, 22*b*, 22*c*, 26*a*, 26*b* can be selected by means of selector keys 48*a*, 48*b* and then appears in the indicator field 50. In a second switching field 52, the correcting factor $K_S$ or $K_K$ can then likewise be set by means of selector keys 54*a*, 54*b* to a desired value which appears in the indicator field 55. In a third switching field 56, finally, it is possible to set the weft or weft region for which the correcting factor $K_S$ or $K_K$ is set in each case is to be applicable. By means of selector keys 58*a*, 58*b*, the number of the weft $x_1$ to $x_n$ can be set, the said values then being indicated on the indicator fields 60*a*, 60*b*. An actuating key X serves for changing the indicator field or for generally resetting the settings, so that the control device controls the components solely according to the pattern program entered. In the example shown, a correcting factor $K_S$=102% is set on the correcting apparatus for the thread transport device number 26*a* and means that the already individual normal delivery length, which is predetermined by the control means on the basis of the pattern program and amounts to 100%, is to be increased by 2%. This value will then apply to the wefts $x_1$ and $x_2$ or $x_1$ to $x_2$.

By means of the correcting apparatus, a correcting factor $K_W$ can be superposed not only on the normal delivery quantity of the weft threads, but, alternatively or additionally, also on the delivery quantity of one or more warp threads and/or on the speed of the cloth take-up. The correcting factors $K_S$, $K_W$, $K_K$ may be identical for various components, but they are preferably different. Particularly for the thread transport devices 26*a*, 26*b*, illustrated in the exemplary embodiment, for the weft threads, a different correcting factor $K_S$ may have to be provided when weft threads of different type are supplied by these thread transport devices 26*a* and 26*b*. The same also basically applies in a similar way to the correcting factors $K_K$ for the thread transport devices 22*a*, 22*b*, 22*c* for the warp threads.

LIST OF REFERENCE SYMBOLS $K_S$ Correcting factor for the weft thread
$K_W$ Correcting factor for the cloth take-up
$K_K$ Correcting factor for the warp threads
X Actuating key
2 Weaving station
4 Warp threads
6 Shedding device
8 Shed
10 Weft thread
12 Cloth edge
14 Woven cloth
16 Cloth take-up
18 Cloth roll
20 Warping frame
20*a* Warping frame
20*b* Warping frame
20*c* Warping frame
22*a* Thread transport device
22*b* Thread transport device
22*c* Thread transport device
24*a* Thread bobbin
24*b* Thread bobbin
26*a* Thread transport device
26*b* Thread transport device
28 Motor
30 Gear
32 Roller
34 Roller
38 Control device
40 Pattern apparatus
40 Floppy disk
42 Reader
44 Display screen
46 First switching field
48*a* Selector key
48*b* Selector key
50 Indicator field
52 Second switching field
54*a* Selector key
54*b* Selector key
55 Indicator field
56 Third switching field
58*a* Selector key
58*b* Selector key
60*a* Indicator field
60*b* Indicator field

The invention claimed is:

1. A ribbon loom for producing a woven cloth having a desired width, the ribbon loom including:

at least one electrically driven thread transport device for supplying at least one weft thread, a cloth take-up for the woven cloth, and an electronic control device for controlling the ribbon loom on the basis of a pattern program for the woven cloth to be produced, characterized in that:

the control device has control means in order to automatically set, at the at least one thread transport device, a delivery length of the weft thread being supplied; and, wherein the delivery length of the at least one thread transport device is calculable using data from the pattern program, the cloth take-up and the width of the woven cloth being produced.

2. The ribbon loom as claimed in claim 1, characterized by an electrically driven further thread transport device for the warp threads, the control device also having control means in order automatically to set, at the thread transport device, the delivery length of the warp threads to be supplied, according to the data predetermined in the pattern program, the delivery length of the further thread transport device for the warp threads likewise being calculable, using data from the pattern program, the cloth take-up and the width of the woven cloth to be produced.

3. The ribbon loom as claimed in claim 1, characterized in that the control device has a manually actuable correcting apparatus for individually superposing an adjustable correcting factor $K_S$ upon the pattern-compatible functioning data of at least the delivery data of the weft thread for at least one weft insertion.

4. The ribbon loom as claimed in claim 3, characterized in that the correcting apparatus has calculation means for individually superposing an adjustable correcting factor ($K_K$, $K_W$) upon the delivery data of the warp threads and/or the functioning data of the cloth take-up.

5. The ribbon loom as claimed in claim 3, characterized in that the correcting apparatus has a display screen and also an indicator and control plane for the manual setting of at least one of the correcting factors ($K_S$, $K_W$, $K_K$).

6. The ribbon loom as claimed in claim 2, characterized in that the control of the at least one thread transport device is designed as an integrated constituent of the machine control.

7. The ribbon loom as claimed in claim 3, characterized in that it has at least two electrically driven thread transport devices for weft threads.

8. The ribbon loom as claimed in claim 7, characterized in that the setting of different correcting factors $K_S$ provided for the at least two electrically driven thread transport devices for weft threads.

9. The ribbon loom as claimed in claim 2, characterized in that the control device has a manually actuable correcting apparatus for individually superposing an adjustable correcting factor $K_S$ upon the pattern-compatible functioning data of at least the delivery data of the weft thread for at least one weft insertion.

10. The ribbon loom as claimed in claim 9, characterized in that the correcting apparatus has calculation means for individually superposing an adjustable correcting factor ($K_K$, $K_W$) upon the delivery data of the warp threads and/or the functioning data of the cloth take-up.

11. The ribbon loom as claimed in claim 4, characterized in that the correcting apparatus has a display screen, preferably a touch screen, and also an indicator and control plane for the manual setting of at least one of the correcting factors ($K_S$, $K_W$, $K_K$).

12. The ribbon loom as claimed in claim 10, characterized in that the correcting apparatus has a display screen and also an indicator and control plane for the manual setting of at least one of the correcting factors ($K_S$, $K_W$, $K_K$).

13. The ribbon loom as claimed in claim 3, characterized in that the control of the at least one thread transport device is designed as an integrated constituent of the machine control.

14. The ribbon loom as claimed in claim 4, characterized in that the control of the at least one thread transport device is designed as an integrated constituent of the machine control.

15. The ribbon loom as claimed in claim 5, characterized in that the control of the at least one thread transport device is designed as an integrated constituent of the machine control.

16. The ribbon loom as claimed in claim 3, characterized in that it has at least two electrically driven thread transport devices for weft threads.

17. The ribbon loom as claimed in claim 4, characterized in that it has at least two electrically driven thread transport devices for weft threads.

18. The ribbon loom as claimed in claim 5, characterized in that it has at least two electrically driven thread transport devices for weft threads.

19. The ribbon loom as claimed in claim 6, characterized in that it has at least two electrically driven thread transport devices for weft threads.

20. The ribbon loom as claimed in claim 3, characterized in that the setting of different correcting factors $K_S$ is made possible for the at least two electrically driven thread transport devices for weft threads.

* * * * *